United States Patent [19]

Lubitzsch

[11] 3,943,805

[45] Mar. 16, 1976

[54] METHOD AND APPARATUS FOR THE PRODUCTION OF STAPLE SLIVERS FROM TOWS OF FILAMENT FIBERS

[75] Inventor: Wolfgang Lubitzsch, Lubeck-Gr. Steinrade, Germany

[73] Assignee: Schubert & Salzer Maschinenfabrik Aktiengesellschaft, Ingolstadt, Germany

[22] Filed: Feb. 5, 1975

[21] Appl. No.: 547,257

[30] Foreign Application Priority Data

Feb. 5, 1974 Germany ..... 2405474

[52] U.S. Cl. ..... 83/23; 83/329; 83/423; 83/913

[51] Int. Cl.[2] ..... D01G 1/04

[58] Field of Search ..... 83/913, 329, 423, 23; 65/2, 9, 11

[56] References Cited

UNITED STATES PATENTS

| | | | |
|---|---|---|---|
| 2,154,256 | 4/1939 | Zimmerman | 83/423 |
| 2,397,047 | 3/1946 | Roberts | 83/423 X |
| 3,448,647 | 6/1969 | Miller et al. | 83/423 |
| 3,768,356 | 10/1973 | Gamble | 83/423 X |
| 3,866,499 | 2/1975 | Messner | 83/423 X |

FOREIGN PATENTS OR APPLICATIONS

| | | | |
|---|---|---|---|
| 253,666 | 4/1967 | Austria | 83/329 |

*Primary Examiner*—Frank T. Yost
*Attorney, Agent, or Firm*—Bailey & Dority

[57] ABSTRACT

A method and apparatus for producing staple fibers of a predetermined length from a substantially endless tow of fibers. The tow of fibers is fed onto needles carried in rows on a carrier under tension. The carrier is rotated past a cutting area and a depositing area. As the rows of needles pass the cutting area the tow of fibers is raised away from the surface of the carrier to enable cutting of the fibers by a cutter blade. The cut fibers are held by the needles until such reach the depositing area wherein the particular row of needles is retracted to deposit the cut fibers on a receiving means.

18 Claims, 8 Drawing Figures

14
12
13
1
15
11
53
21
2
52
21
24
54
56
57
55
51
10
3
5

METHOD AND APPARATUS FOR THE PRODUCTION OF STAPLE SLIVERS FROM TOWS OF FILAMENT FIBERS

BACKGROUND OF THE INVENTION

The present invention relates to a method and apparatus for the production of staple cut fibers and more particularly to the method and apparatus for cutting tows of endless filament fibers to produce cut fibers of predetermined lengths which can be subsequently made into sliver.

It is well known to produce staple fibers by cutting a tow of filament fibers with a rotating knife that creates a pulling cutting effect. One such device is disclosed in German Pat. No. 964,213 which discloses two sets of endless conveyor belts, each set of which includes a pair of belts that touch each other. The two sets of belts are positioned on opposite sides of a cutting area. Between adjacent guide rollers of the sets of conveyor belts is a guiding slot. The tow of fibers is spread in an arcuate fashion and fed to the cutting area so that rotating circular knives can cut the endless fibers into predetermined lengths as the fibers move through the guiding slot. During the cutting operation the tow of fibers are held by the guide rollers of the feeding and removing conveyors. In such an apparatus however, the free ends of the cut endless fibers have to be moved ahead by the conveyors and guided into the grip of the guide rollers since the continuity of the fibers have been interrupted by the cut. This cannot be achieved very satisfactorily since the flexible fiber ends are free and tend to move to the side when they hit the guide rollers of the removing conveyors. As a result, the parallel alignment of the fibers is interfered with since a large amount of fiber ends are not being held by the guide rollers of the removing conveyors. Therefore, a precise and good quality sliver of uniform length fibers cannot be achieved.

In another device, such as disclosed in German Pat. No. 928,119 a continuously moving fiber tow is placed in a circumferential groove of a rotating wheel and guided in it to a cutting area. At the cutting area a rotating knife passes through radial slots provided in the rotating wheel for cutting the tow of fibers which is being held in place on the wheel before and after the cutting area by steel fingers. This apparatus however, has one drawback in that the fibers fall freely from the wheel after cutting and their partial alignment and orientation is lost.

Still another device for cutting a tow of endless fibers is disclosed in German Pat. No. 683,113. In this device a needle bed is positioned between a pair of feeding cylinders and a pair of removing cylinders. The tow of fibers passes between the needles in the needle bed and is cut by a cutting disc that moves transversely of the direction of the tow so that each is a reflected image of the preceeding cut. One disadvantage of such a device is that the cutting takes place between the feeding cylinders and the needle bed which tends to interfere with the parallel alignment of the fibers.

Another problem is that only cut fibers can be produced that are longer than the distance between the pairs of feeding cylinders and the needle bed since only then is a necessary support provided for the fiber filament.

The cutting through spaces between the needles of the needle bed has the advantage that the tow of filament fibers is being forced to stay between the pair of feeding cylinders and the needle bed and therefore staples of shorter lengths can be cut. The disadvantage of the uncontrolled freedom of movement of the cut fibers between the needle bed and the pair of removing cylinders remains however with this device especially with short fibers, and therefore an even fiber sliver cannot be produced. In addition, the material has an unsteady support on the needle bed since the needles of the needle rods have to be spaced apart to allow the knife to cut through the spaces between the needles. Since the knife has contact with the needle rod body while the filament fibers lying on the same are being cut, an overall unsatisfactory cutting quality results and the possibility of damaging the knife and the needle rod body arises.

SUMMARY OF THE INVENTION

This invention includes a method and apparatus for producing fibers of a predetermined length from at least one tow of substantially endless fibers. The method includes depositing a tow of fibers on rows of needles carried on a carrier; moving the carrier with said fibers carried thereon to a cutting area; cutting the tow of fibers into predetermined lengths along said rows of needles at an angle to the direction of movement of the carrier and the rows of needles; and moving the carrier to a receiving area for removing the cut lengths of fibers from said carrier and depositing same on a receiver, all such without giving up the parallel alignment of the fibers.

The tow of fibers carried by the rows of needles is raised away from the carrier as the needles are moved into the cutting area for spacing the tow of fibers from the surface of the carrier to enable a free cutting of the fibers. The row of needles are retracted into the carrier as the needles approach the receiving area for depositing the cut fibers onto a receiver.

The apparatus for carrying out the above mentioned method includes an endless movable carrier which has rows of needles carried thereon defining a needle bed. The rows of needles are circumferentially spaced around the carrier at an angle relative to the direction of movement of the carrier. A tow of fibers is deposited on the needle bed under tension. A rotatable cutting blade is provided for cutting said tow of fibers into predetermined lengths as said fibers pass through said cutting area. In one such embodiment the carrier is a rotating cylinder having circumferentially spaced radially extending slots provided therein. A needle rod is carried within each of the slots for supporting a row of needles at a angle relative to the direction of travel of the cylinder. A cam follower is positioned on opposite sides of the cylinder for engaging the needle rods so as to move the rows of needles up from the surface of the cylinder as they approach the cutting area for holding the fibers away from the surface of the cylinder during cutting. The needle rods are moved radially inwardly within the cylinder as the rods approach the delivery area so as to dislodge the fibers from the needles.

The fibers are deposited onto a receiving means in the form of a conveyor belt which can have guides positioned on opposite sides thereof. To reduce the friction with the guides and to aid in moving the fibers forward, one of the guides can be movable in the direction of the transport. A short second conveyor is positioned above the transport conveyor for pressing the cut fibers against the transport conveyor as such are moved forward. If desired, a drafting means may be added after the transport conveyor and the second conveyor and if so the guide rolls of these two conveyors and the belts passing therearound may form the first point of clasping of the drafting device. The drafted fibers may be turned into a sliver by placing the cut fibers onto two conveyors which run together in the form of a funnel. In one particular embodiment, the two conveyors may change direction so as to change the direction of flow of the fibers. After the fibers leave the funnel shaped conveyors such can be, if desired, fed into other processing devices such as a stuffer box and can.

Accordingly, it is an important object of the present invention to provide an apparatus for cutting tows of fibers into predetermined lengths.

Still another important object of the present invention is to provide a device for cutting fibers into predetermined lengths while maintaining the fibers in parallel relation.

Still another important object of the present invention is to provide a method and apparatus for cutting tows of fibers with rotating knives in a meticulous manner while maintaining the fibers in parallel alignment even after the cutting so as to produce a sliver of uniform fibers.

These and other objects and advantages of the invention will become apparent upon reference to the following specification, attendant claims and drawings.

DESCRIPTION OF A PREFERRED EMBODIMENT

Figure 1:
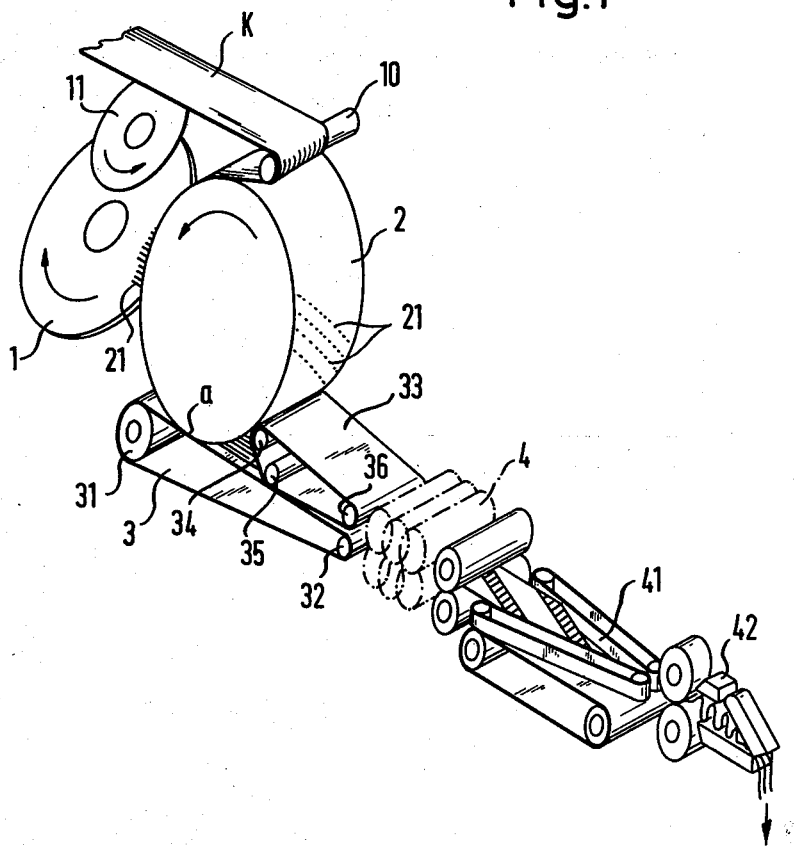
FIG. 1 is a perspective view partially in schematic form illustrating a device constructed in accordance with the present invention.

Referring in more detail to FIG. 1 of the drawings there is a device constructed in accordance with the present invention. The device includes a rotating cutting head 1 having rotating circular knives 11, 12 and 13 provided thereon. Positioned adjacent the rotating cutting head 1 is a carrier 2 provided for transporting a tow of fibers K under tension to the cutting head 1. The carrier 2 is in the form of a cylinder provided with circumferentially spaced rows of needles 21 provided thereon defining a needle bed. A cutting area is defined at a junction where the cutting head 1 engages the tow of fibers K carried on the cylinder 2.

The tow of fibers K are cut on the cylinder 2 and such are carried to a receiving area where they are deposited on a conveyor 3 which is carried between guide rollers 31 and 32. The conveyor has an upper run which passes closely adjacent the lower surface of the cylinder 2 for receiving the cut fibers from the cylinder 2. Positioned above the transport conveyor 3 and directly forward thereof is a second shorter conveyor which works in conjunction with conveyor 3 to transport the cut fibers. The conveyor 33 is supported on the quide rolls 34, 35 and 36. The drive mechanisms for the conveyors and drafting devices which will be subsequently discussed, will not be disclosed in detail since such is conventional. The second conveyor 33 is supported on rollers 34, 35 and 36.

After the fibers leave from between the conveyors 3 and 33, such if desired, can be fed to a drafting device 4 followed by a tape forming device 41 and stuffer box 42.

Figure 2:
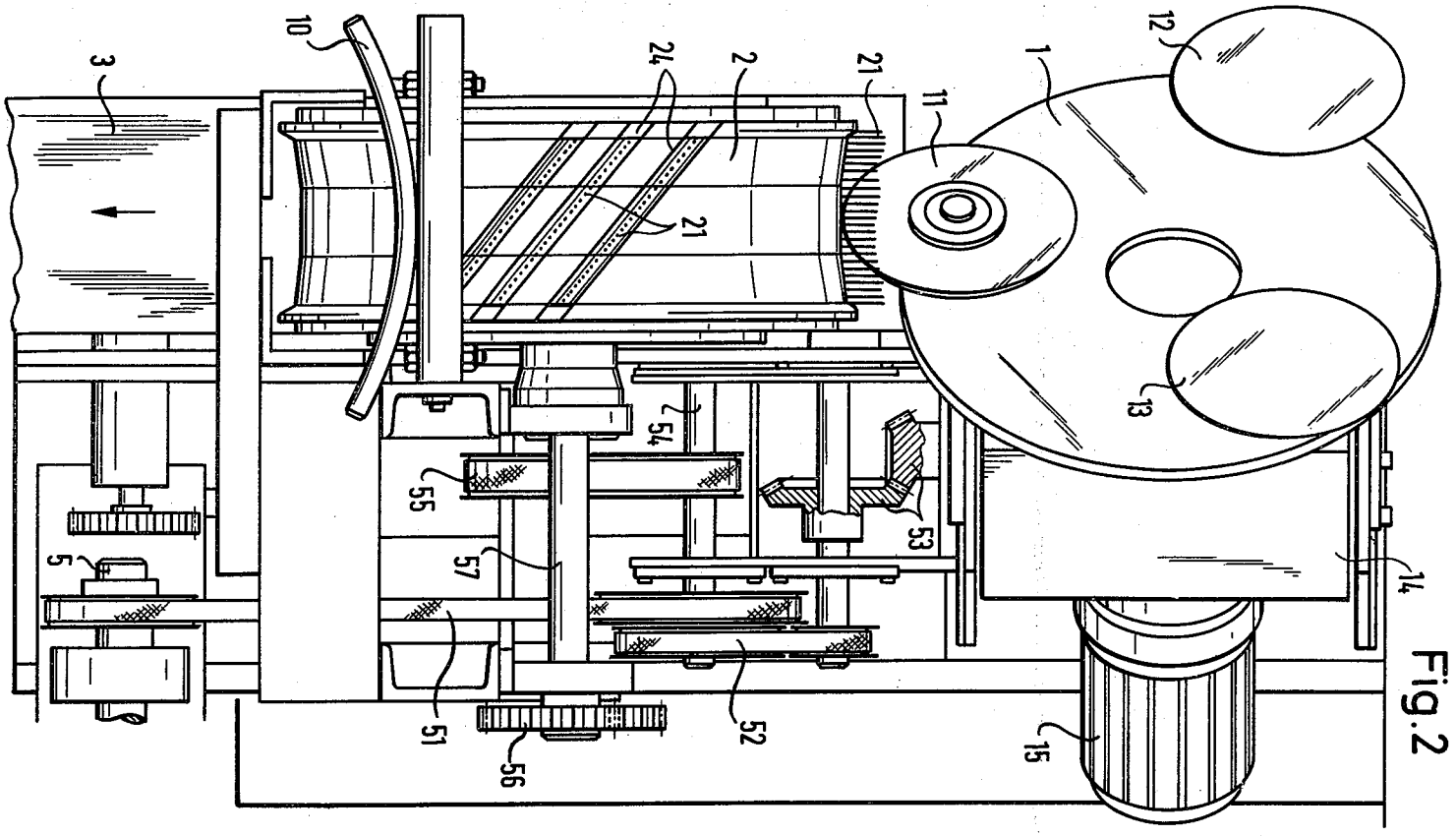
FIG. 2 is a more detailed plan view of the device illustrated in FIG. 1, particularly showing the drive mechanisms therefor.

Positioned above the cylinder 2 is a bow-shaped bar 10 (FIG. 1 and FIG. 2) which serves to gather the tow K of filament fibers and to aid in maintaining such under tension as it is fed onto the cylinder 2.

The cutting head 1, which is supported in a frame 14, is rotatable and swingable and has at least one circular rotatable knife 11 provided thereon. If desired, however, more knives such as illustrated at 12 and 13 may be attached to the rotating cutting head 1. The drive for the circular knives 11, 12 and 13 is provided by a motor 15 whose shaft is connected with the shaft upon which the knives 11 are carried by belts. Such produces a repeating cutting action.

The drive mechanism for the cutting head 1 is provided by a motor (not shown) that is connected to shaft 5. Belts 51 and 52 coupled around pulleys carried on shafts 54 and 54a are used for driving the bevel gear drive 53. The bevel gear drive 53 in turn, is coupled by a second bevel gear drive (not shown) to a shaft upon which the rotatable cutting head is mounted for rotating the cutting head 1.

The shaft 54, which is rotated by belt 51 transfers its movement by means of a belt 55 to a shaft (not shown in FIG. 2) which has a gear wheel at its end which meshes with a gear wheel 56 carried on the end of shaft 57 for rotating the cylinder 2.

The shaft 5 also rotates the guide rollers 31 and 36 (FIG. 1) of the conveyors 3 and 33 with belts (not shown), preferably in such a way that the moving speed of the conveyor belts 3 and 33 is adjustable but normally slower than the circumferential speed of the cylinder 2. Thus, it can be seen since the cylinder 2 and the cutting head 1 are driven from the same shaft 5 that the speed of rotations thereof are synchronized.

A plurality of needle rows are circumferentially spaced in radially extending slots 24 provided in the cylinder 22. The needles of each of the rows have their lower ends supported on a support plate 26 by any suitable means. The support plate 26 is, in turn, mounted on a needle rod 22 that has outwardly extending heads 23 provided on the outer ends thereof which are provided to travel in stationary cam followers 25 provided on both sides of the cylinder 2. The track carried in the template defining the cam follower 25 is of such a configuration that a continuous in and out movement is imparted to the circumferentially spaced rows of needles as the cylinder 2 is rotated.

Figure 3:
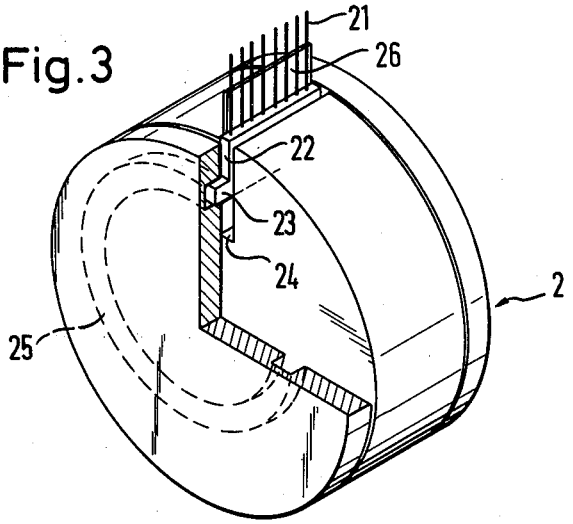
FIG. 3 is an enlarged perspective view with portions cut away for purposes of clarity illustrating a carrier cylinder utilized in the invention.

While only a single row of needles is shown in FIG. 3, it is to be understood that similar rows of needles 21 are circumferentially spaced around the cylinder 2 in radially extending slots 24. The spacing between the rows of needles 21 should be small so that the lengths of fibers cut can be varied from a short fiber to a long fiber while still maintaining a gripping action on the fibers by the teeth of adjacent rows of needles 21.

Figure 4:
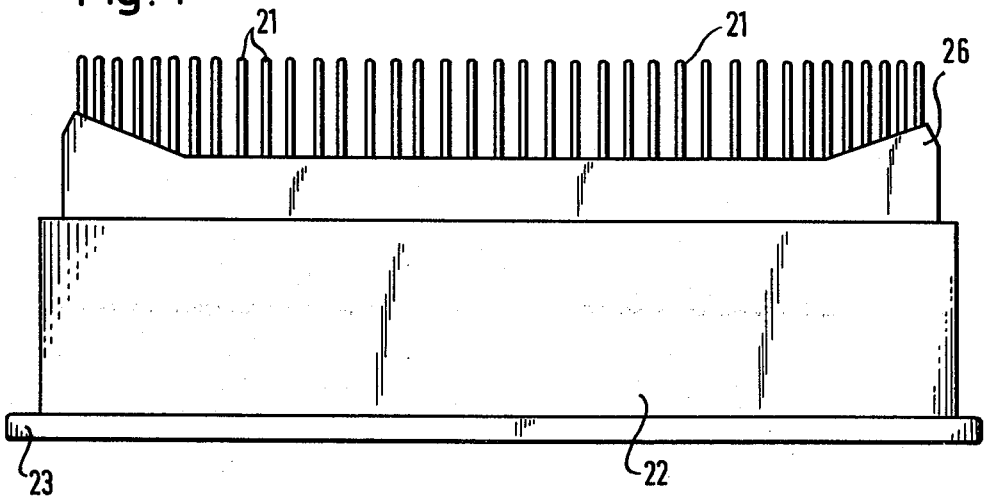
FIG. 4 is an enlarged side elevational view illustrating a needle rod utilized on the cylinder of FIG. 3.

As shown in FIG. 4, the density of the needles adjacent the ends of the support plate 26 is greater than in the middle so that the fibers on the outer edges of the tow will be gripped securely while the majority of the fibers are concentrated adjacent the central portion of the support plate 26.

Figure 5:
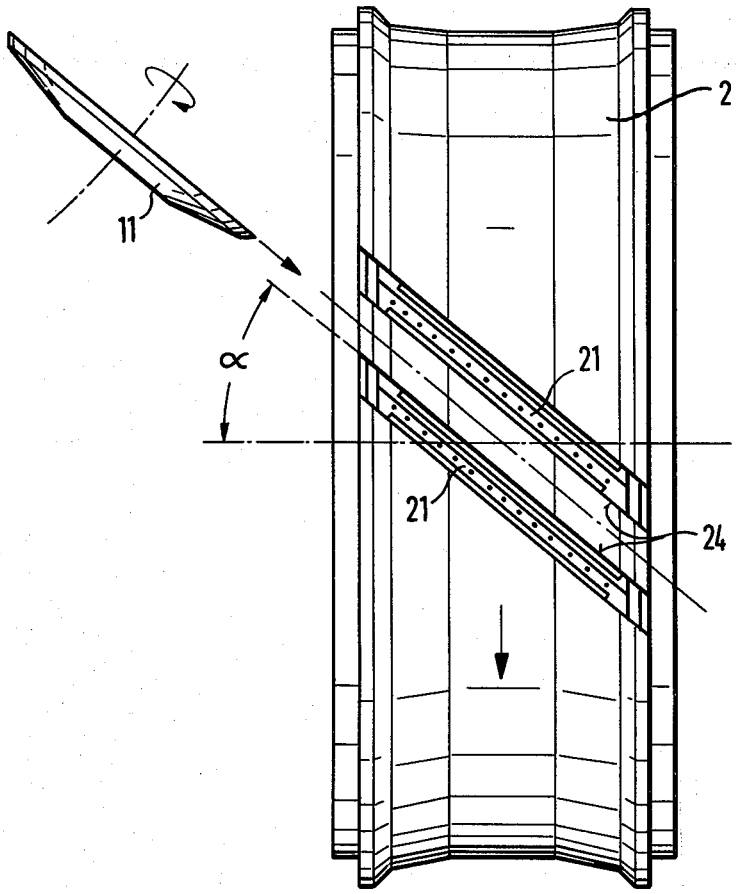
FIG. 5 is an enlarged plan view illustrating the cylinders of FIGS. 1, 2 and 3.

As shown in FIG. 5 the radially extending slots 24 in the cylinder body 2 in which the needle rod 22 and rows of needles carried thereon are guided, are placed at an angle $\alpha$ to their direction of movement and the rotating circular knife 11 moves along the needle rows parallel thereto. As previously mentioned, since both the cutting head 1 and the cylinder 2 are rotated by the same drive motor, connected to shaft 5, the rotation of such is synchronized so that the cutting knife 11 moves down the row of needles 21 during the cutting operation parallel thereto without interfering or striking them.

In operation the cutting device is fed with at least one tow of fibers which has been previously loosened and separated. The tow is gathered by the bow-shaped bar 10 to the width of the cylinders 2 and preferably put down under tension onto the cylinder 2 which forms the carrier. At the point of deposit the needles rows 21 of the needle rods 22 are still on the inside of the cylinder 2. However, needle rows 21 move out continuously immediately after the deposit of the tow onto the cylinder surface 2 as a result of the heads 23 riding in the cam followers 25 placing the tow K on the needles. As the cylinder 2 rotates further the needle rods 22 move radially outwardly from the surface of the cylinder 2 so that the support plate 26 grasps the tow K and lifts it from the surface of the cylinder 2. Therefore, as the needle rows 21 approach the cutting area where the cutting knives 11 through 13 are positioned, the tow of fibers K rests freely on the support plate of the needle rod 22 out of contact with the surface K of the cylinder. While the tow of fibers K are held away from the surface of the cylinder 2 the circular knife 11 moves between adjacent needle rows at an angle fitted to the movement of the needle rows and penetrates as far as necessary through the tow of fibers to cut them. At the same time the needle rows 21 create a holdback force in the direction of the surface of the cylinder 2 and the support plate 26 creates a force in the direction against the cut of the circular knife so as to enable the rotatable cutter 11 to make a precise, complete and steady cut thereof.

The cut fiber package is in a parallelogram shape and remains under the force guidance of at least one needle row 21 since the cut fibers extend thereacross. These cut fibers are carried on the needle rows 21 until they reach a point of deposit *a* without giving up the parallel alignment of the fibers in direction of transport. The cut pieces of fibers are deposited on the conveyor 3 as the needle rows 21 are gradually retracted back into the cylinder by the cam followers 25. As can be seen, the needles are retracted until their points are at least below the surface of the cylinder by the time they have reached the point a of deposit. At the same time the edges of the slots 24 of the cylinder 2 slide the cut fibers from the needles.

It is also possible to use a jet of air for aiding in blowing the cut fibers off of the needle rows 21 if desired. In such an apparatus the air sream could move through the slots 24.

Since the upper run of the conveyor 3 reaches at least to the point a of deposit closely adjacent to the cylinder 2, it holds the fibers tightly and guides the cut pieces of fibers while they are being deposited on the conveyor 3. In that manner the pieces of cut fibers are laid on the conveyor 3 in the manner that they were cut and retain their parallel alignment.

If, as mentioned above, the speed of conveyor 3 is slower than the speed of rotation of the needle rows 21 the single parallelogram shaped fiber packages produced by the individual cuts are pushed together in the direction of movement of conveyor 3 which is favorable to the subsequent drafting operation. The fiber package produced by the individual cuts of the tow are wedged between the transport conveyor 3 and the second upper conveyor 33. These two conveyors guide the packages under a clasping force to the drafting device 4. The clasping point created between the guide rollers 32 and 36 of the conveyors 3 and 33 may form part of the drafting operation performed by the drafting device, which is subsequently followed by any suitable mechanism such as a tape forming device 41 and a stuffer box 42 for producing a staple sliver.

Figure 6:
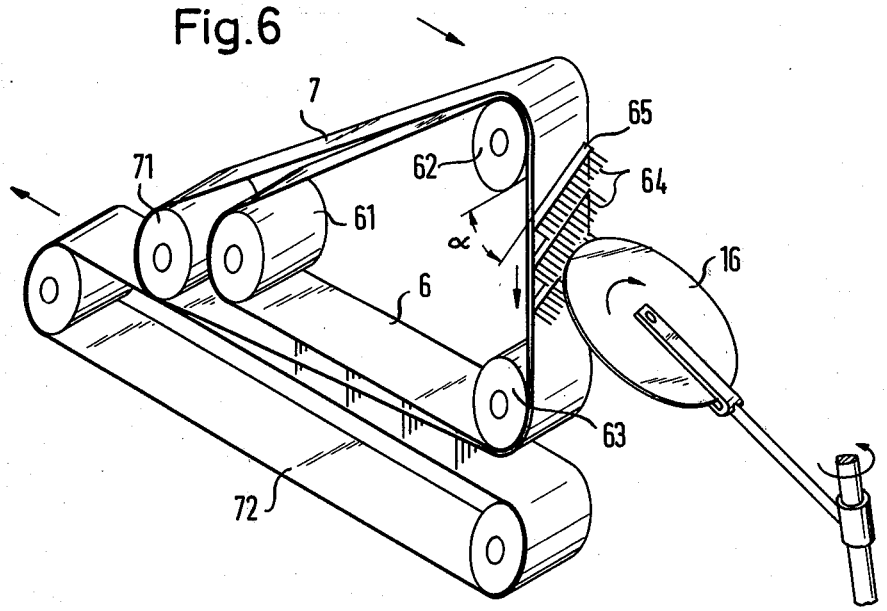
FIG. 6 is a perspective view illustrating a modified form of the invention wherein a different type of carrier is utilized.

In a modified form of the invention instead of utilizing a cylinder 2, another carrier for the tow of fibers can be utilized such as illustrated in FIG. 6. This particular carrier includes a rotating endless belt 6 which is being guided over three guide rollers 62, 61 and 63. The belt has needles rows 64 with support plates 65 at their foot provided thereon. The needle rows are carried at an angle $\alpha$ to the direction of the movement of the belt 6 in the same manner as the needle rows 21 on the cylinder 2. A circular knife 16 is moved along the needle rows 64 for cutting the tow of fibers.

A second rotating endless band 7 is guided over the band 6 in such a way that it also moves along the guide rollers 62 and 63 and a third guide point created by a guide roller 71.

The guide roller 71 is placed at a distance from guide roller 61 upon which band 6 is carried and below the area where the guide roller 61 and 63 of band 6 are located. Band 7 has spaced slot, (not shown) provided therein which correspond to the spacing of the needle rows 64 on the band 6. The slots as well as the needle rows 64 are at an angle $\alpha$ to their direction of movement. The needle rows and the slots are so positioned relative to each other that the needle rows 64 with the support plates extend through the slots provided in the belt 7 as such approaches the cutting knife 16.

The function of the carrier shown in the embodiment of FIG. 6 is the same as that of the cylinder 2 discussed above. The needle rows 64 are gradually moved out of the belt 6 a distance until the support plate 65 lifts the tow that is to be cut from the surface of the conveyor belt 7. The tow of fibers passes over the upper roller 62 as indicated by the arrow downwardly through the needle row 64 and back over the conveyor belt 72 as indicated by the arrow associated therewith. After the tow of fibers has been cut by the cutting blade 16 the cut pieces are carried by the needle rows downwardly for depositing such onto the conveyor 72. As can be seen, as the rows of needle 64 approach the roller 61 the belts 6 and 7 separate withdrawing the needle rows 64 below the surface of the belt 7 causing the fibers carried thereon to be deposited onto the upper surface of the conveyor 72. The conveyor 72 moves slower than the needle rollers 64 in the same manner as the embodiment in FIG. 1 and the parallel alignment of the fibers is maintained.

Figure 7:
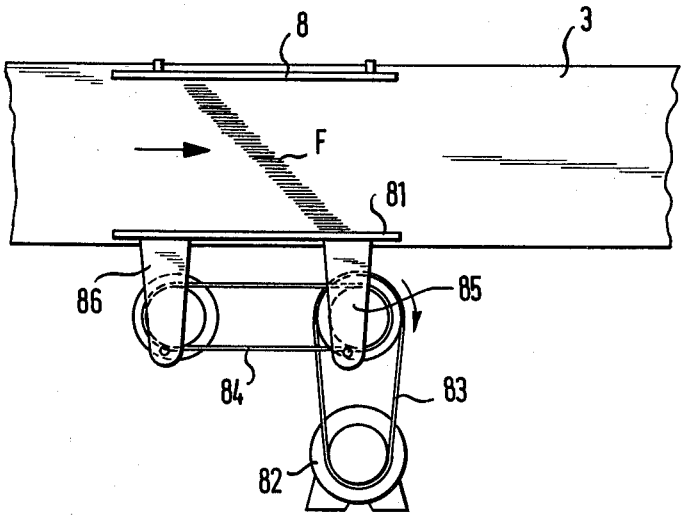
FIG. 7 is a plan view of the transport conveyor with fibers being carried thereon and guided by a pair of spaced guide plates.

A device constructed in accordance with the present invention may have further alteration. For example, conveyor 3 may be provided with fiber guides on both sides of conveyor 3 between cylinder 2 and the guide roller 35 of the conveyor 33 (FIG. 1). These guides can for instance, be in the form of vertically extending plates 8 and 81 as shown in FIG. 7 for securing the fiber packages F which are fixed on the conveyor 3 at an angle to their direction of movement. The plates 8 and 81 may be stationary but it has been proven to be more advantageous for plate 81, which is lcoated at the side of conveyor 3 and which holds the fiber package F to be movable in the direction of transport so as to reduce the friction between the fiber packages F and the plate. The plate 81 can be moved in a cyclic motion by the rotation of motor 82. Connected to the output of motor 82 by means of a belt 83 is a roller 85. A spaced roller 86 is connected by a belt 84 to the shaft upon which roller 85 is rotated. It can be seen that the plate 81 is eccentrically connected to the rollers 85 and 86 so that as the rollers 85 and 86 are rotated the plate 81 is cyclically moved to aid in moving the fibers in the direction of flow on the conveyor 3.

If the conveyor 33 is eliminated, which is possible, plates 8 and 81 which serve as fiber guides, may extend to the end of conveyor 3.

Figure 8:
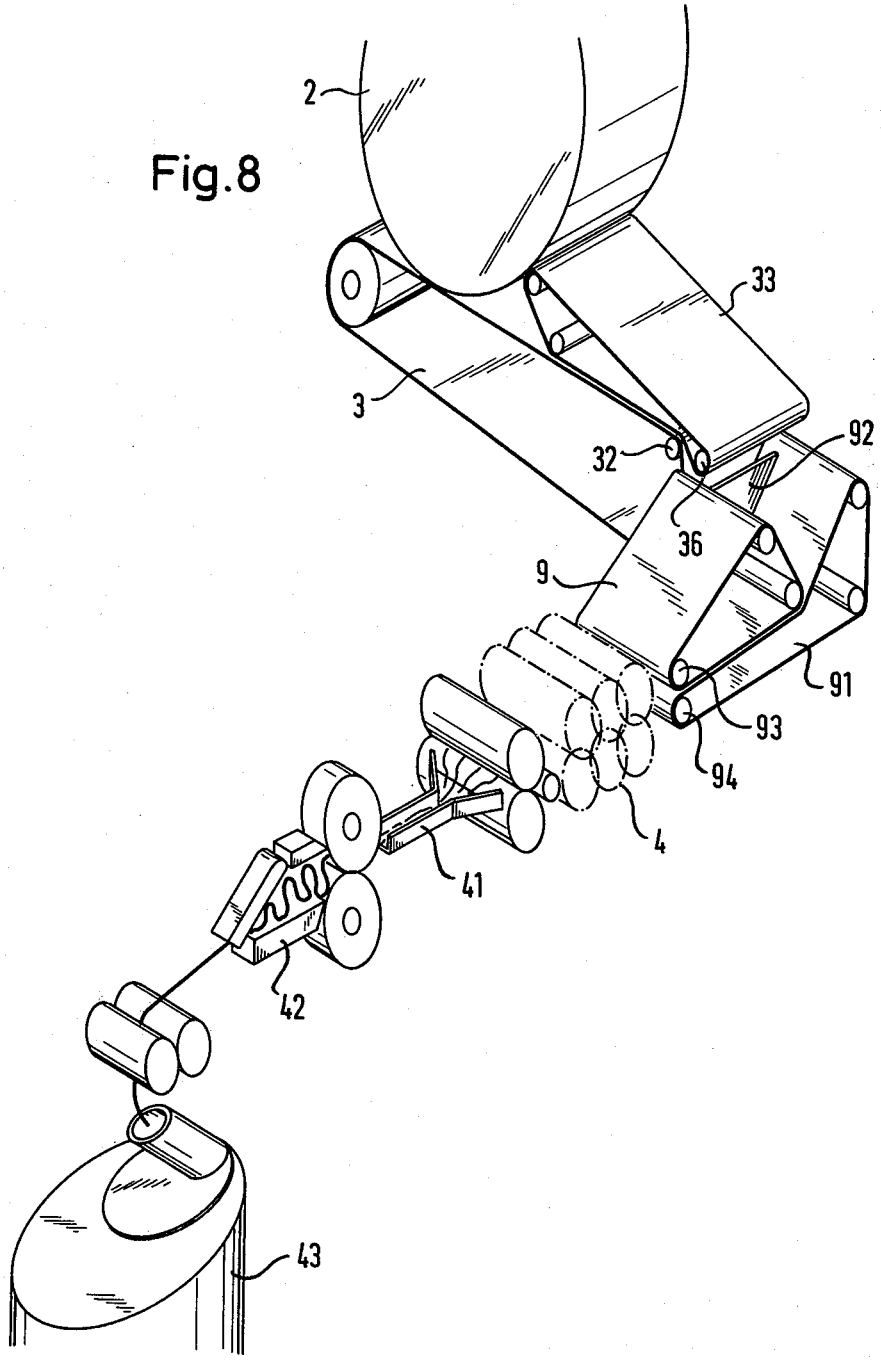
FIG. 8 is a perspective view illustrating a modified device for transporting the cut fibers to further processing and storage equipment.

A further variation of the device is illustrated in FIG. 8. Here the conveyors 3 and 33 are followed by two funnel-shaped conveyors 9 and 91 whose transport direction has been turned 90° vertically to the transport direction to conveyor 3. The guide roller 36 of conveyor 33 and the guide roller 32 of conveyor 3 are placed horizontally so that the fiber packages are guided downwardly through the funnel formed at the receiving end of conveyors 9 and 91. The fiber packages are guided by a vertical plate 92 into the funnel. In moving through the clasping point formed by conveyors 9 and 91, the fiber packages are turned 90° around the transport axis and form a solid web which can be drafted without interference in the drafting device 4. The first clasping point of the drafting mechanism is created by the guide rolls 93 and 94 at the exit of conveyors 9 and 91.

The drafted fiber web is gathered by a tape forming device 41 and after passing through a stuffer box 42 is deposited in a can 43. The present invention contemplates a method and device for producing a highly uniform staple sliver from one or more tows of substantially endless filament fibers of any fineness. Different materials can be used to achieve mixtures. Also, a variation of the staple configuration is possible, for example, by an irregular distribution of the knife assembly on the cutting head or by feeding tows of different tensions thereto.

The various lengths of fibers cut depends on the distance that the needle rows are spaced from each other and such can be varied by changing the drive gears 56 for the cutting head 1 and the cylinder 2 so as to vary the speed of rotation therebetween. That way the circular knife 11 can be moved for example between every second or third needle row 21 of the needle bed rather than between every row of needles 21 of the needle bed.

While a preferred embodiment of the invention has been described using specific terms, such description is for illustrative purposes only, and it is to be understood that changes and variations may be made without departing from the spirit or scope of the following claims.

What is claimed is:

1. An apparatus for producing predetermined lengths of fibers from an endless tow of fibers comprising:

a. a carrier;
b. means for moving said carrier in a first direction;
c. transverse rows of needles carried on said carrier;
d. said transverse rows of needles being positioned on said carrier at an angle relative to said first direction of movement of said carrier;
e. means for continuously depositing said endless tow of fibers on said transverse rows of needles in a path parallel to said first direction of movement of said carrier;
f. a rotating cutting blade, and
g. means for repeatedly moving said rotating cutting blade substantially transverse to said tow of fibers as said fibers are moved by said carrier on said rows of needles for cutting said fibers into predetermind lengths.

2. The apparatus as set forth in claim 1 wherein, said means for moving said rotating cutting blade moves said rotating cutting blade across said moving tow of fibers at an angle corresponding to the angle of said transverse rows of needles.

3. The apparatus as set forth in claim 1, wherein said carrier is a rotating carrier.

4. The apparatus as set forth in claim 1 wherein;

a. said carrier is a rotating cylinder;
b. circumferentially spaced radially extending slots provided in said cylinder;
c. a needle rod supporting each of said transverse rows of needles within a respective slot; and
d. a cam follower means carried adjacent said rotating cylinder for moving said rows of needles with said tow of fiber thereon in and out relative to the surface of said cylinder for enabling cutting and depositing of said fibers.

5. The apparatus as set forth in claim 4 wherein said cam follower includes:

a. a stationary template carried on opposed sides of said cylinder;
b. a track provided in a side wall of each of said templates for receiving said needle rods and guiding said needle rods radially in and out as said cylinder is rotated.

6. The apparatus as set forth in claim 4, wherein:

a. said needles supported on said rods are spaced closer together adjacent the ends of said rods than in the middle of said rods.

7. The apparatus as set forth in claim 6 wherein the surface on said rods adjacent where a foot portion of said needles are supported on said rods provides a supporting surface for said tow of fibers.

8. The apparatus as set forth in claim 4 wherein, said rotating cutting blade is positioned relative to said cylinder for cutting said tow of fibers when said row of needles with said tow carried thereon is moved out from the surface of said cylinder.

9. The apparatus as set forth in claim 8 further comprising:

a. a transport conveyor carried adjacent said cylinder for receiving said cut fibers from said cylinder, and
b. said transport conveyor having a slower surface speed than the speed that said cylinder rotates said rows of needles.

10. The apparatus according to claim 9 wherein:

a. said transport conveyor is an elongated conveyor belt;

b. guide means positioned on both sides of said conveyor belt for maintaining said cut fibers on said belt as said fibers are being transported.

11. The apparatus as set forth in claim 10 wherein:

a. one of said guide means is movable with said conveyor belt.

12. The apparatus as set forth in claim 9 further comprising:

a. a second conveyor superimposed on said transport conveyor for aiding in transporting said cut fibers.

13. The apparatus as set forth in claim 12 further comprising:

a. superimposed guide rollers supporting said transport conveyor and said second conveyor in an extended position;

b. a drafting device positioned adjacent and following said guide rollers for receiving said cut fibers from between said transport conveyor and said second conveyor;

c. said transport conveyor and said second conveyor adjacent said guide rollers engaging said cut fibers and defining a clasping point for said drafting device.

14. The apparatus as set forth in claim 12 further comprising:

a. a pair of conveyors following said transport conveyor and said second conveyor for receiving cut fibers therefrom.

b. said pair of conveyors being positioned relative to each other for defining a funnel shaped receiving end and an exit end turned 90° to said receiving end for changing the direction of flow of aid cut fibers.

15. A method of producing fibers of a predetermined length from at least one tow of substantially endless fibers comprising:

a. depositing said tow of fibers on rows of needles carried on a carrier;

b. moving said carrier with said fibers carried thereon to a cutting area;

c. cutting said tow of fibers into predetermined lengths along said rows of needles at an angle to the direction of movement of carrier and rows of needles, and d. moving said carrier to a receiving area for removing said cut lengths of fibers from said carrier and depositing same onto a surface of a moving receiver.

e. moving said surface of said receiver closely adjacent said carrier at said receiving area as said cut lengths of fibers are deposited thereon for maintaining said cut lengths of said fibers in parallel alignment during transfer from said carrier onto said receiver.

16. The method of producing fibers of a predetermined length as set forth in claim 15 further comprising:

a. raising said rows of needles with said tow of fibers carried thereon away from said carrier as said rows of needles are moved into said cutting area for enhancing the cutting of said tow of fibers.

17. The method of producing fibers of a predetermined length as set forth in claim 15 further comprising:

a. moving said rows of needles inwardly relative to said carrier as said carrier approaches said receiver for aiding in removing said cut fibers from said rows of needles and depositing same on said receiver.

18. The method of producing fibers of a predetermined length as set forth in claim 17 further comprising:

a. placing said tow of fibers under tension as said tow of fibers is deposited on said row of needles on said carrier.

* * * * *